United States Patent [19]

Nishimoto

[11] 4,295,728

[45] Oct. 20, 1981

[54] CONVEYING SYSTEM WITH SNAKE MOTION PREVENTION MEMBERS INCORPORATED THEREIN FOR PHOTO TREATMENT APPARATUS OF LONG LENGTH PHOTO-SENSITIVE SHEET MATERIALS

[75] Inventor: Kanichi Nishimoto, Wakayama, Japan

[73] Assignee: Noritsu Koki Co., Ltd., Wakayama, Japan

[21] Appl. No.: 70,539

[22] Filed: Aug. 28, 1979

[30] Foreign Application Priority Data

Sep. 5, 1978 [JP] Japan ..... 53-108104

[51] Int. Cl.[3] ..... G03D 3/13

[52] U.S. Cl. ..... 354/321; 354/339; 134/122 P; 226/196; 226/198

[58] Field of Search ..... 354/316, 319, 320, 321, 354/322, 338, 339; 134/64 P, 122 P; 226/91, 196, 198

[56] References Cited

U.S. PATENT DOCUMENTS 3,956,764 5/1976 Schausberger ..... 354/319

4,110,774 8/1978 Krehbiel et al. ..... 226/91

*Primary Examiner*—L. T. Hix

*Assistant Examiner*—Alan Mathews

*Attorney, Agent, or Firm*—William E. Jackson

[57] ABSTRACT

A conveying system with snake motion prevention members incorporated therein for a photo-treatment apparatus in which a variety of treatments are applied to a plurality of long length photo-sensitive sheet materials such as long length photo films, while a wide leader is adapted to lead and pull said long length photo-sensitive sheet materials which are connected to the tail portion of said leader, wherein said conveying system is provided with pendulum type snake motion prevention members of which snake motion prevention portions are energized to normally protrude into the travelling passage of the leader which proceeds along guide members and on both sides of the travelling passage of the long length photo-sensitive sheet materials which proceed along another guide and curl prevention members so that when the leader is to pass, said pendulum type snake motion prevention members are rotated outside the travelling passage of the leader by means of the front end portion thereof and then when the whole leader has passed, they protrude again on both sides of the travelling passage of the long length photo-sensitive material so as to prevent any snake motion of the same.

7 Claims, 6 Drawing Figures

CONVEYING SYSTEM WITH SNAKE MOTION PREVENTION MEMBERS INCORPORATED THEREIN FOR PHOTO TREATMENT APPARATUS OF LONG LENGTH PHOTO-SENSITIVE SHEET MATERIALS

BACKGROUND OF THE INVENTION

1. Field of the Invention

The present invention relates to an improved conveying system for a photo treatment apparatus in which a plurality of long length photo-sensitive sheet materials such as long length photo films are subjected to a variety of chemical treatment and more particularly to a conveying system with snake motion prevention members incorporated therein which ensures prevention of snake motion and smooth and reliable conveyance of the long length photo-sensitive materials connected to the tail portion of a wide leader, said plurality of long length photo sensitive materials being led and pulled by means of the single leader so that they are conveyed in parallel to each other along guide rollers disposed at a predetermined distance. As well known, snake motion of such long length photo-sensitive sheet materials is most undesirable for smooth and reliable conveyance and represents one of main factors causing problems in the technical field of the art.

The phrase "snake motion" as used herein means the sideways movement of a long length photo-sensitive sheet material in a direction perpendicular to its direction of travel through the conveying system and in the same plane as the sheet material.

2. Description of the Prior Art

In a typical conventional photo-treatment apparatus in which such a conveying system as described above is incorporated is known a socalled developing apparatus which is constructed such that a long length photo-film is subjected to a variety of treatments such as water washing, developing, fixing, stabilizing, hardening and others, while being led and pulled along guide rollers arranged at a predetermined distance therebetween or guide grooves for guiding the both edges of the long length photo-film or the like by means of a leader of which tail portion serves as a junction to the long length photo-film. One of main requirements for carrying out the aforsaid treatments in this sort of photo-treatment apparatus in an effective manner is that a long length photo-film should be displaced and conveyed smoothly and reliably. To this end a variety of techniques has been developed for prevention of snake motion which is considered as one of factors causing problems and thus a variety of measures have been taken against it. As cameras become more popular among people and thereby a large number of photo-files are consumed at a remarkably increasing rate, people require an automatic developing apparatus in which several lines of long length photo-film connected to the tail portion of a single wide leader are treated at the same time so as to improve operational efficiency of the automatic developing apparatus. This makes it impossible to apply the conventional technique further and thus urgent development of new technique has been requested for improved efficiency of operation of the automatic developing apparatus without waiting for such request from users of this sort of automatic developing apparatus. Further improvements in apparatus for the processing and developing of long-length photo-files has been made impossible because of the snake motion that occurs in the long-lengh photo-films as they are drawn through the machine and which becomes worse as the speed of travel through the apparatus is increased, because the snake motion reduces the quality of the resulting product and reduces the operating efficiency of the apparatus.

SUMMARY OF THE INVENTION

In view of the above mentioned current situation with the automatic photo treatment apparatus as mentioned above, the present invention has been developed for a conveying system for a photo-treatments apparatus in which a variety of treatment including water washing, developing, fixing, stabilizing and hardening is applied to long length photo-sensitive sheet materials such as long length photo-films, while a wide leader is adapted to lead and pull several lines of long length photo films which are connected to the tail portion of said leader, wherein said conveying system is provided with pendulum type snake motion prevention members of which snake motion prevention portions are energized to normally protrude into the travelling passage of the leader which proceeds along guide members and on both sides of the travelling passage of the long length photo-sensitive sheet materials which proceed along another guide and curl prevention members, while being led and pulled by means of said leader, so that when the leader is to pass, they are rotated away outside the travelling passage of the leader by means of the front end portion of the leader and then when the whole leader has passed, they protrude again on the both sides of the travelling passage of the long length photo-sensitive sheet materials so as to prevent any snake motion of the same.

Thus it is a major object of the present invention to provide an improved photo treatment apparatus with a conveying system incorporated therein, which is excellent in operation and ensures photo-treatment of several lines of long length photo-sensitive sheet material at the same time with the aid of a single wide leader to which said long length photo sensitive materials are connected in parallel to each other at the tail portion thereof.

It is other object of the present invention to provide a photo-treatment apparatus with a conveyer system incorporated therein, which ensures smooth and reliable conveyance of several lines of long length photo-sensitive sheet material without fail, which are connected to the tail portion of a single wide leader in parallel to each other, said single wide leader serving to lead and pull them at the same time.

It is another object of the present invention to provide a photo-treatment apparatus with a conveying system incorporated therein for long length photo-sensitive sheet materials, which is simple in structure and easy to be manufactured.

It is still another object of he present invention to provide a photo-treatment apparatus with a conveying system having pendulum type snake motion prevention members incorporated therein, said snake motion prevention members being reliable in operation and simple in structure.

Other objects and advantages features of the present invention will be easily understood from the following detailed description of preferred embodiments of the invention.

BRIEF DESCRIPTION OF THE ACCOMPANYING DRAWINGS

The drawings attached hereto illustrate a conveying system for long length photo-films in accordance with two preferred embodiments of the present invention, in which:

FIG. 1 is a vertically sectioned view of the conveying system with snake motion prevention members incorporated therein, which is immersed in a treatment bath of an automatic developing apparatus for long length photo-films in accordance with the first embodiment of the invention, taken in line I—I in FIG. 2 and seen in the direction as indicated by the arrow marks thereof, in which less significant parts and components for the system are neglected for the purpose of simplification of illustration.

DETAILED DESCRIPTION OF THE PREFERRED EMBODIMENTS

Figure 1:
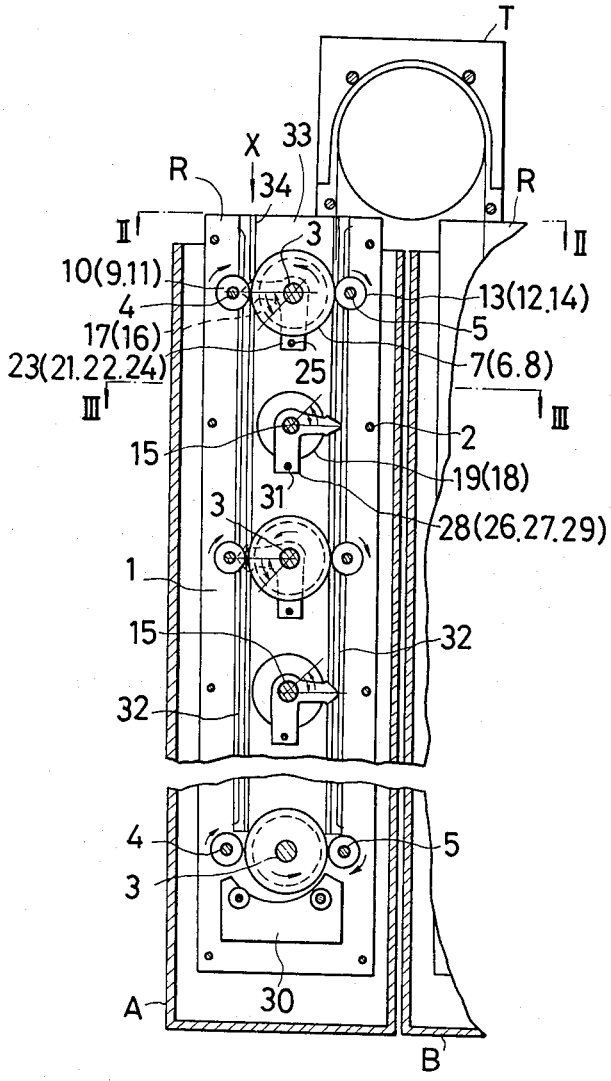

FIGS. 1 to 5 illustrate the conveying system for a plurality of long length photo-films with snake motion prevention members incorporated therein in accordance with the first preferred embodiment of the invention, said conveying system being adapted to a rack of an automatic developing apparatus in which a variety of chemical treatment is carried out for long length photosensitive materials. In FIG. 1 the reference symbols A, B—denote a treatment bath for long length photo-films (not shown) respectively, in which a number of treatments including water washing, developing, fixing, stabilizing, hardening and others are effected therein. The reference symbol R denotes a rack immersed and suspended in the treatment bath. The reference symbol T denotes an upper turn roller which serves for guiding a leader (not shown) and long length photo-films to be conveyed (not shown) connected to the tail portion of said leader into another rack in the treatment bath of the next stage, said leader acting as a leading and pulling member for the following long length photo-films, and the reference symbol X denotes a direction to which the leader is introduced through the conveying system of the invention.

In FIG. 1 the reference numeral 1 denotes channel shaped frames vertically disposed opposite to each other at a predetermined distance therebetween with the aid of a plurality of stay rods 2 extending horizontally between said frames 1. These channel shaped frames 1 are in a form similar to that of the conventional ones. Further the reference numerals 3, 4 and 5 denote a driving shaft respectively, which is rotatably journaled through the both frames. The driving shafts 4 and 5 are arranged at an equal distance from the driving shaft 3 on the both sides thereof and extend in parallel. Further the reference numeral 15 denotes a stationary shaft secured to the both frames. As seen from FIG. 1, the respective stationary shaft 15 is disposed between the two driving shafts 3, one being located in the upper adjacent stage and the oher being located in the lower adjacent stage. Said driving shafts 3 and said stationary shafts 15 are alternately arranged in the vertical direction, as illustrated in FIG. 1.

Figure 4:
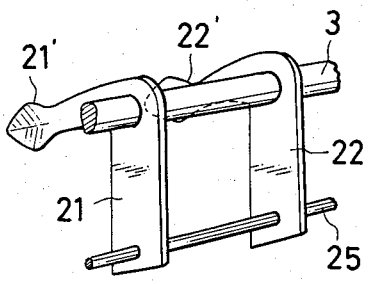
FIG. 4 is a perspective view of a left-sided snake motion prevention member which is incorporated in the conveying system.
Figure 5:
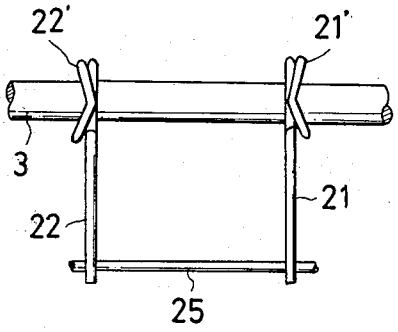
FIG. 5 is a front view of the snake motion prevention member as illustrated in FIG. 4.

Large diameter rollers 6, 7 and 8 are mounted on the driving shaft 3 at a predetermined distance therebetween for exerting leading and pulling force on the leader (not shown), of which width is dimensioned wider than that of the long length photo-films to be conveyed (not shown), small diameter roller 9, 10, 11, 12, 13 and 14 in cooperation with said large diameter rollers 6, 7 and 8 are mounted on said driving shafts 4 and 5 free rollers 16 and 17 which are smaller in diameter than said large diameter rollers 6, 7 and 8 are loosely mounted on said driving shaft 3 in place between the large diameter rollers 6 and 7 and between the large diameter rollers 7 and 8 respectively, said free rollers 16 and 17 serving to guide the long length photo-films to be conveyed (not shown) and at the same time preventing the end portion of the photo-films from rolling in due to curling or the like deformation thereof. Further a plurality of inverted L shaped pendulum type snake motion prevention members 21, 22, 23 and 24 are loosely mounted on the driving shaft 3 so as to prevent snake motion of the long length photo-films. As illustrated in FIGS. 4 and 5, the inverted L shaped snake motion prevention members 21, 22, 23 and 24 are constructed of two pendulum arms located in a spaced relation, which comprizes two arm sections, one of them being a vertical arm section which acts as a weight and the other being a horizontal arm section which is formed with a snake motion prevention portion 21', 22', 23' and 24' at the end portion thereof. Particularly the snake motion prevention members 21, 22, 23 and 24 are constructed in such a manner that the horizontal arm sections thereof normally extend horizontally due to the gravity force of the vertical arm sections thereof, while they are under no load and when the leader is displaced through the engagement portion between the large diameter rollers 6, 7 and 8 and the small diameter rollers 9, 10 and 11, they are depressed and swung away by means of the top end portion of the travelling leader and then when the whole leader has passed therethrough, they are restored to the original position where the long length photo-films are conveyed without any snake motion. Further the reference numeral 25 denotes a connecting rod secured to the lower portions of the vertical arm sections of the snake motion prevention members 21, 22, 23 and 24 so as to connect them therebetween, said connecting rod 25 extending in parallel to the driving shaft 3. As seen in FIGS. 4 and 5, the arrow shaped snake motion prevention portions 21', 22', 23' and 24' protruded beyond the outer periphery of the free rollers 16 and 17 are formed such that the upper and lower parts thereof are a little from each other in the outward direction.

In the lowermost portion of the frame 1 the driving shafts 3, 4 and 5 are arranged also. Since this portion of the conveying system is intended just for converting the direction of conveyance of the long length photo-films, a direction conversion device 30 is located in place of the aforesaid inverted L shaped pendulum type snake motion prevention members.

Free rollers 18 and 19 having the substantially same shape as that of the free rollers 16 and 17 loosely supported on the driving shaft 3 are loosely rotatably arranged on the stationary shaft 15. Further inverted L shaped pendulum type snake motion prevention members 26, 27, 28 and 29 are loosely mounted on said stationary shaft 15 in place on both sides of the free rollers 18 and 19 in such a manner as to surround the same therebetween. As seen from FIG. 1, said inverted L shaped pendulum type snake motion prevention members 26, 27, 28 and 29 having snake motion prevention portions 26', 27', 28' and 29' at the top end thereof have a symmetrically same form as that of the aforesaid inverted L shaped pendulum type snake motion prevention members 21, 22, 23 and 24. The reference numeral 31 denotes a connecting rod extending in parallel to the stationary shaft 15, which serves in the substantially same manner as the aforesaid connecting rod 25.

Figure 2:
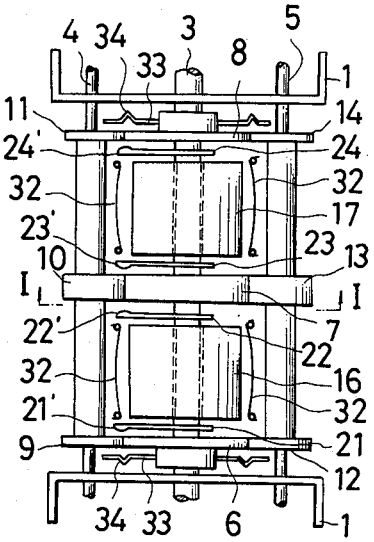
FIG. 2 is an end view of the conveying system seen from above in the direction as indicated by the arrow marks of line II—II in FIG. 1.
Figure 3:
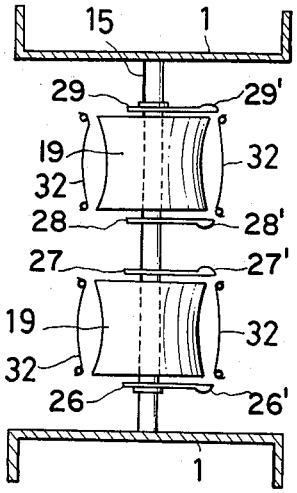
FIG. 3 is a cross sectional view of the system, taken in line III—III in FIG. 1 and seen in the direction as indicated by the arrow marks thereof.

In FIGS. 2 and 3, the reference numeral 32 denotes a guide and curl prevention slat for the long length photo-films and the reference numeral 33 denotes a guide plate with a groove for guiding the leader at its both edges. It is to be noted that adjusting means or the like for adjusting the distance between the free rollers 16 and 17 and the inverted L shaped pendulum type snake motion prevention members 21, 22, 23 and 24, all of which are loosely mounted on the driving shaft 3 and between the free rollers 18 and 19 and the inverted L shaped pendulum type snake motion prevention members 26, 27, 28 and 29 and moreover between the large diameter rollers 6, 7 and 8 and the both channel shaped frames 1 respectively are neglected for the purpose of simplification of illustration, because said adjusting means or the like are not required in some cases.

Now operation of the conveying system in accordance with the first embodiment of the invention will be described below.

To the tail end of the leader which has such a width as to be guided by means of the guide plate 33 with the groove 34 formed thereon are connected the long length photo-films to be treated at such a distance therebetween as to be guided alternately by means of a first set of free rollers 16 and 17 and a second set of free rollers 18 and 19, and the leader is displaced along the groove 34 of the guide plate 33 in the direction as marked with "X" by driving the respective driving means (not shown) located in the treatment bathes A, B—. Thus the leader is conveyed by means of the large diameter rollers 6, 7 and 8 and the small diameter rollers 9, 10, 11, 12, 13 and 14 securely mounted on the driving shafts 3, 4 and 5, whereby the long length photo-films connected to the rear part of the leader are displaced and conveyed by pulling force exerted on the leader.

As the leader is conveyed, the respective inverted L shaped snake motion prevention members 21, 22, 23 and 24 having the snake motion prevention portions 21', 22', 23' and 24' located in the travelling passage of the leader and on the both sides of the long length photo-films are depressed by means of the front end portion of the leader, while the respective inverted L shaped snake motion prevention members 26, 27, 28 and 29 having the snake motion prevention portions 26', 27', 28' and 29' are raised by means of the front end portion of the leader, whereby they are rotated about the driving shafts 3 and the stationary shafts 15, causing them to be rotated away outside the travelling passage of the leader. When the whole leader has passed, the respective inverted L shaped pendulum type snake motion prevention members 21, 22, 23 and 24 as well as the respective inverted L shaped pendulumt type snake motion prevention members 26, 27, 28 and 29 are released from rotation caused by means of the leader, whereby they are restored to the original position so that their snake motion prevention portions 21', 22', 23', 24', 26', 27', 28' and 29' are located on the both sides of the travelling passage of the long length photo-films. As a result the long length photo-films are smoothly displaced without any snake motion owing to the arrangement of the inverted L shaped snake motion prevention members and the inverted L shaped snake motion prevention members as well as the curl prevention slats 32 as described above.

In this connection it is to be noted that in the above described first embodiment of the invention the driving shafts 3 and the stationary shafts 15 are alternately arranged but a modification may be made in such a manner that the stationary shafts 15 are replaced with another driving shafts 3 on which the free rollers 18 and 19 and the inverted L shaped snake motion prevention members 26, 27, 28 and 29 all of which were allocated to said stationary shafts 15 are loosely mounted.

Next, the conveying system in accordance with the second embodiment of the present invention will be described with reference to FIG. 6. In this second embodiment of the invention similar or same parts and components a those in the first embodiment are given the same reference numeral with an addition of 100 thereto. Hence further description of these parts and components is neglected for the purpose of simplification. It should be understood that the parts and components of which illustration is neglected have the substantially same structure and function as those in the first embodiment of the invention.

As described above, the respective inverted L shaped pendulum type snake motion prevention members 21, 22, 23 and 24 and the respective inverted L shaped pendulum type snake motion prevention members 26, 27, 28 and 29 are restored to the original position, that is, the position where snake motion prevention is effected for the travelling long length photo-films, only by gravity force in case of the first embodiment of the invention. In this second embodiment, however, the snake motion prevention members are restored to the original position by means of resilient means such as leaf spring, wire spring or the like which are adapted to exert on the snake motion prevention members.

Figure 6:
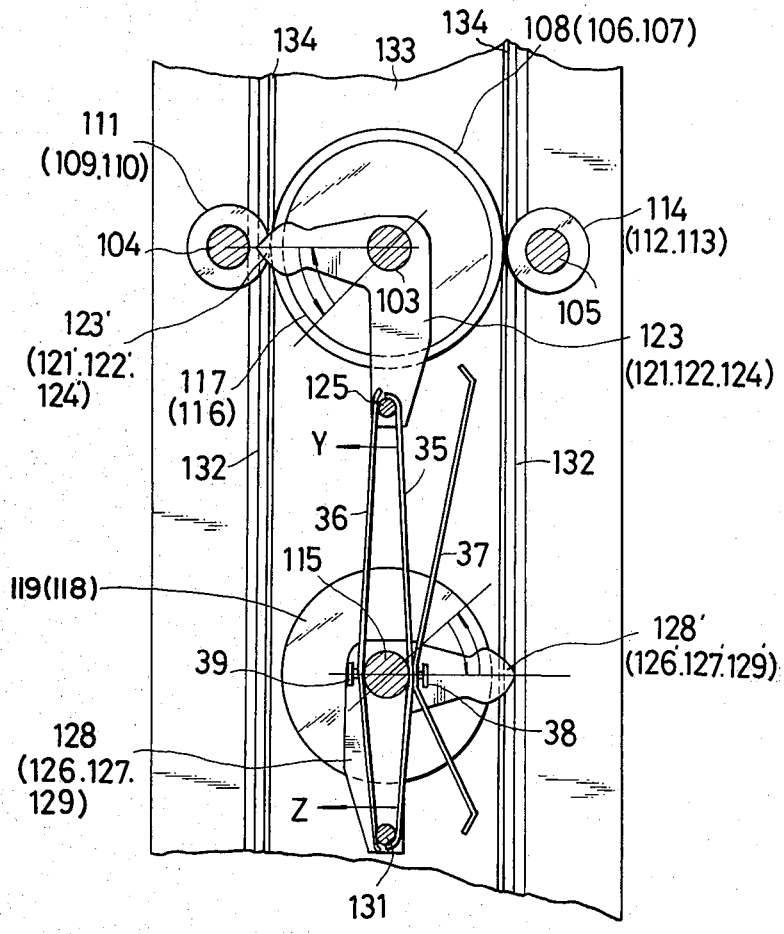
FIG. 6 is a partial vertical sectional view of the conveying system for long length photo-films with snake motion prevention members incorporated therein in accordance with the second embodiment of the invention, illustrated in a longer scale than in the case of FIG. 1.

In FIG. 6 the reference numeral 35 denotes a leaf spring which comes always in engagement with the connecting rod 125 which is secured to the lower part of the vertical weight arm sections of the inverted L shaped pendulum type snake motion prevention members 121, 122, 123 and 124 and the connecting rod 131 which is secured to the lower part of the vertical weight arm sections of the inverted L shaped pendulum type snake motion prevention members 126, 127, 128 and 129 so as to provide rotative force in the direction as marked with "Y" and "Z". This leaf spring 35 serves to rotate the inverted L shaped pendulum type snake motion prevention members as well as the inverted L shaped pendulum type snake motion prevention members so that their horizontal arm sections with the snake motion prevention portions 121', 122', 123', 124', 126', 127' and 128' and 129' at the top end thereof are located on the both sides of the travelling passage of the long length photo-films to be conveyed. The reference numerals 36 and 37 denotes a stopper respectively, which serves to restrict the angular extent of rotation of the respective inverted L shaped pendulum type snake motion prevention members 121, 122, 123 and 124 and the respective inverted L shaped pendulum type snake motion prevention members 126, 127, 128 and 129, the reference numeral 38 denotes a set screw for fixing the spring 35 and stopper 37 onto the stationary shaft 115 and the reference numeral 39 denotes a set screw for fixing the stopper 36 onto the stationary shaft 115.

Since the conveying system in accordance with the second embodiment of the invention is such that the restoring force to the original position is forcedly provided for the snake motion prevention members by means of the leaf spring 35, it is ensured that they are restored to the original position without fail, no matter how the leader or the long length photo-films are travelling.

The invention having been thus described, what is claimed as new and desired to secure by the Letters Patent is:

1. In an improved automatic developing apparatus for long-length photo-sensitive sheet materials of the type having a treatment bath containment means into which means are immersed and suspended for directing, locating and controlling the path of travel of a plurality of long-length photo-sensitive sheet materials attached to the trailing end of a wide leader, said means including a plurality of roller means to fix the path of travel of a wide leader, and guide means to position said leader along said directing means, the improvement which comprises:

(a) said directing means has a plurality of free roller means rotatably mounted on respective shafts;

(b) a plurality of guide means for guiding and curl prevention extending parallel to the path of travel and spaced in juxtaposition to said free roller means which confine the long-length photo-sensitive sheet materials to a narrow gap path of travel between said free roller means and said guide means;

(c) a plurality of motion prevention means for prevention of relative sideways motion of said sheet materials, each said means being rotatably mounted on respective said shafts and having a pair of arms extending horizontally forming a space between each pair of arms into which fit said free roller means and which horizontal arms extend toward said guide means to close up the sides of the narrow gap formed between said guide means and said free roller means so as to limit the amount of relative sideways motion in the long-length photo-sensitive sheet materials by further defining the desired travel path; and (d) a plurality of counter balancing means respectively associated with the rotatably mounted plurality of said motion prevention means which normally locate the said pairs of arms thereof in the horizontal position and which provide forces to return said motion prevention means to the original position after the arms are displaced by contact with a wide leader so as to allow the wide leader to pass by.

2. The invention of claim 1 wherein said counter balancing means includes a pair of normally vertical arm sections which serve as weights to provide gravity forces for urging said pair of normally horizontal arms to their horizontal position.

3. The invention of claim 1 wherein said vertical arm sections are connected to each other at the respective lower parts thereof by a connecting rod which extends parallel to said shafts.

4. The invention of claim 1 wherein each of said arms of said pair of arms are formed to diverge outwardly relative to said travel path for said sheet material.

5. The invention of claim 1 wherein said guide means to position said leader along said directing means includes plates having guiding grooves for guiding the edges of said wide leader.

6. The invention of claim 1 wherein leaf spring means are provided to aid said counter balancing means for normally locating said arms in the horizontal position.

7. The invention of claim 3 wherein leaf spring means are provided to aid said counter balancing means for normally locating said arms in the horizontal position, said leaf spring means being engaged with said connecting rod.

* * * * *